US005167871A

United States Patent [19]

Jöllenbeck et al.

[11] Patent Number: 5,167,871

[45] Date of Patent: Dec. 1, 1992

[54] LIQUID DETERGENT COMPOSITIONS CONTAINING FLUORESCENT WHITENING AGENTS, POLYVINYL PYRROLIDONE POLYMER OR COPOLYMER AND SILICIC ACID

[75] Inventors: Martin Jöllenbeck, Freiburg, Fed. Rep. of Germany; Claude Eckhardt, Riedisheim, France

[73] Assignee: Ciba-Geigy Corporation, Ardsley, N.Y.

[21] Appl. No.: 704,660

[22] Filed: May 20, 1991

Related U.S. Application Data

[63] Continuation of Ser. No. 376,108, Jul. 6, 1989, abandoned.

[30] Foreign Application Priority Data

Jul. 8, 1988 [CH] Switzerland ..... 2618/88

[51] Int. Cl.[5] ..... C11D 3/42

[52] U.S. Cl. ..... 252/543; 252/140; 252/524; 252/542; 252/174.25; 252/173; 252/174.23; 252/128; 252/163; 8/648

[58] Field of Search ..... 252/140, 524, 542, 543, 252/174.25, 173, 174.23, 128, 163; 8/648

[56] References Cited

U.S. PATENT DOCUMENTS

| | | | |
|---|---|---|---|
| 3,630,929 | 12/1971 | Van Dijk | 252/135 |
| 4,298,490 | 11/1981 | Lange et al. | 252/91 |
| 4,309,316 | 1/1982 | Lange | 252/524 |
| 4,534,892 | 8/1985 | Suzuki | 252/174.25 |
| 4,618,446 | 10/1986 | Haslop et al. | 252/173 |
| 4,731,194 | 3/1988 | Rossmann | 252/140 |
| 4,756,849 | 7/1988 | Weber | 252/542 |
| 4,790,949 | 12/1988 | Dankowski | 252/99 |
| 4,800,035 | 1/1989 | Broze | 252/153 |
| 4,844,821 | 7/1989 | Marmelstein et al. | 252/DIG. 14 |
| 4,925,595 | 5/1990 | Hefti et al. | 252/89.1 |

FOREIGN PATENT DOCUMENTS

| | | |
|---|---|---|
| 3007796 | 9/1981 | Fed. Rep. of Germany . |
| 406192 | 1/1979 | Sweden . |
| 1535804 | 3/1976 | United Kingdom . |
| 2026054 | 7/1979 | United Kingdom . |
| 2208232 | 7/1988 | United Kingdom . |

OTHER PUBLICATIONS

PTO Structure Search Fluorescent Dyes.

The Chemistry of Synthetic Dyes, Venkataraman p. 550.

Chem. Abstract (24): 205378n of DE80-3007796 (1980).

*Primary Examiner*—Paul Lieberman

*Assistant Examiner*—Bradley A. Swope

*Attorney, Agent, or Firm*—Edward McC. Roberts

[57] ABSTRACT

There are described novel storage-stable liquid detergent compositions which comprise 0.001% to 0.2% of at least one water-insoluble or sparingly soluble fluorescent whitening agent, 0.001% to 0.2% of at least one polymer and/or copolymer, and 0.2% to 5% of at least one highly disperse silicic acid, and to the preparation thereof with the aid of an aqueous dispersion which contains the fluorescent whitening agent and the polymer components, and to the use thereof. When using these liquid detergent compositions for cleaning fabric, no bleach spots are formed.

9 Claims, No Drawings

LIQUID DETERGENT COMPOSITIONS CONTAINING FLUORESCENT WHITENING AGENTS, POLYVINYL PYRROLIDONE POLYMER OR COPOLYMER AND SILICIC ACID

This application is a continuation of application Ser. No. 376,108, filed Jul. 6, 1989 now abandoned.

The present invention relates to storage-stable liquid detergent compositions, to an aqueous whitener dispersion and to the use thereof for preparing said liquid detergent compositions.

It is commonly known to use fluorescent whitening agents in liquid detergent compositions. During treatment they exhaust on to the material to be washed and, by virtue of their special light absorption/emmision properties, they effect a maintenance or enhancement of the original degree of whiteness.

This effect, however, is also responsible for the occurrence of bleach spots when textile fabric comes into direct contact with the concentrated liquid detergent composition, for example in a pretreatment. For this reason, the proposal is made in European patent application 167 205 to solve this problem by using monosulfonated stilbene triazolyl, stilbene triazine or distyrylbiphenyl fluorescent whitening agents.

Surprisingly, it has now been found that the formation of bleach spots can be prevented and the detergent stability simultaneously enhanced with further excellent whitening effect by incorporating an aqueous dispersion a), which contains specific fluorescent whitening agents as well as polymers and/or copolymers, and, in addition, highly disperse silicic acid, into the liquid detergent compositions.

Accordingly, the present invention relates to liquid detergent compositions which comprise 0.001% to 0.2%, preferably 0.01% to 0.1%, of at least one water-insoluble or sparingly soluble fluorescent whitening agent, 0.001% to 0.2%, preferably 0.01% to 0.1%, of at least one polymer and/or copolymer, and 0.2% to 5%, preferably 0.5% to 4%, most preferably 0.5% to 1.5%, of at least one highly disperse silicic acid, based on the liquid detergent composition.

As water-insoluble or sparingly soluble fluorescent whitening agents, the liquid detergent compositions contain, for example, compounds, or mixtures of compounds, of formulae

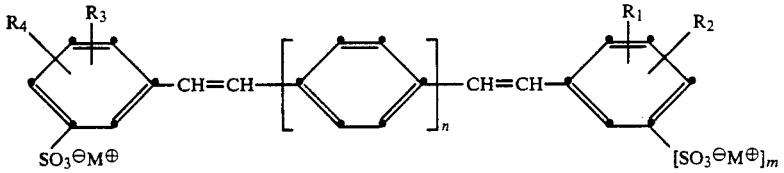

(I)

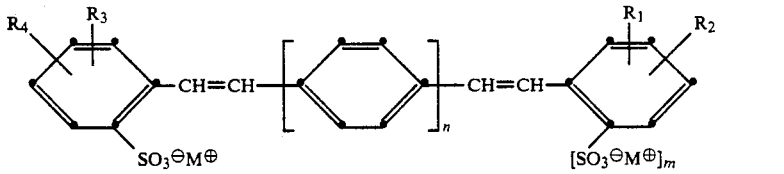

(II)

(III)

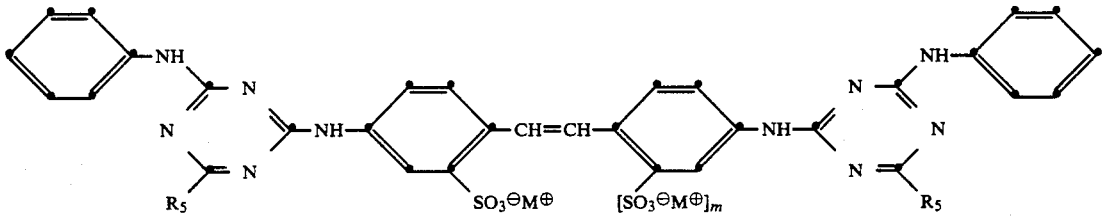

(IV)

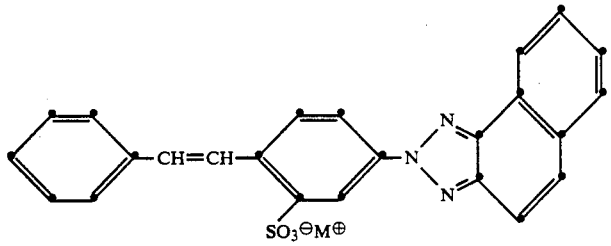

and

-continued

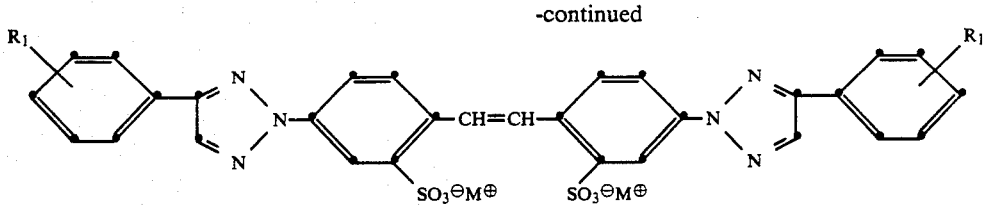

(V)

wherein $R_1$, $R_2$, $R_3$ and $R_4$ are each independently of one another H, Hal or $C_1$–$C_4$alkyl, or, when taken together, are each a cyclohexane radical, $R_5$ is NH-($C_1$–$C_4$alkyl) or a 4-morpholino radical, n is 1 or 2, m is 0 or 1, and $M^{\oplus}$ is a salt-forming cation.

It is preferred to use disulfonic acid fluorescent whitening agents of formula (VI)

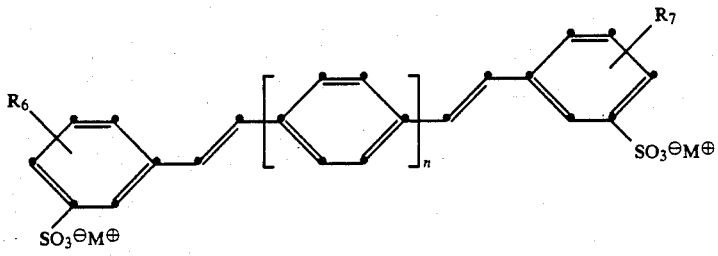

(VI)

wherein $R_7$ and $R_6$ are H, Cl, F or $CH_3$, $M^{\oplus}$ is H, Na, K, Li, $NH_4$, $HN(CH_2—CH_2OH)_3$,

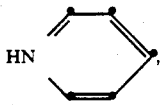

$H_2N(CH_2—CH_2OH)_2$, $H_3N—CH_2—CH_2OH$, $H_2N(CH_3)_2$, or $H_3N—CH_3$, and n is 1 or 2.

It is especially preferred to use disulfonic acid fluorescent whitening agents of formula (VII) or (VIII)

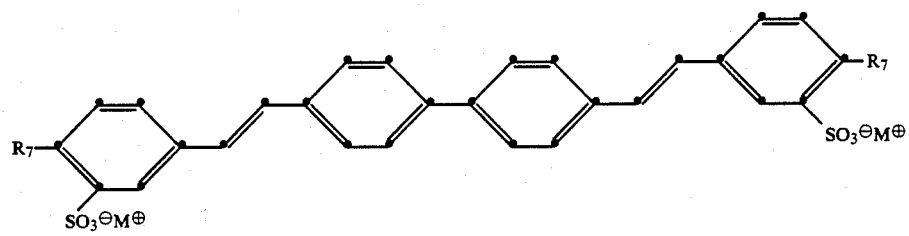

(VII)

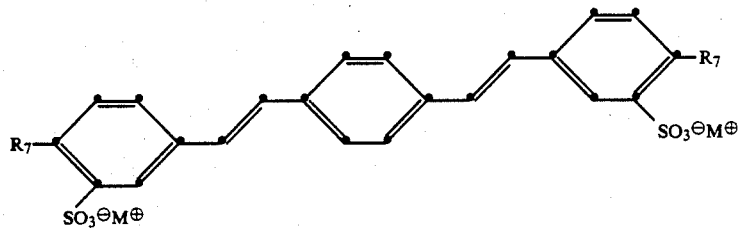

(VIII)

as well as mixtures of 1 to 10, preferably 1 to 5, parts of the compound of formula (VII) with 10 to 1, preferably 5 to 1, parts of the compound of formula (VIII), wherein $R_7$ is H, Cl, F, $CH_3$ and $M^{\oplus}$ is as defined above.

The polymers present in the liquid detergent compositions are preferably vinyl pyrrolidone polymers having an average molecular weight of 8,000 to 1,000,000, preferably of 35,000 to 800,000 and, most preferably, of 35,000 to 50,000 and 600,000 to 800,000. Suitable copolymers (polymerisation products of at least two different monomers) are in particular 1:4 to 4:1, preferably 4:1 to 1:1, most preferably 3:2, copolymers of vinyl pyrrolidone/3-vinylpropionic acid monomers. These copolymers have an average molecular weight of 20,000 to 100,000, preferably of 45,000 to 75,000 and, most preferably, of 60,000.

Mixtures of polymers and copolymers with one another may also be used.

The presence of the polymers and copolymers in the liquid detergent compositions prevents, or at least diminishes, the tendency to form bleach spots (spotting effect) caused by the fluorescent whitening agents.

As further essential component, the liquid detergent compositions contain preferably highly disperse synthetic silicic acid which is hydrophilic or has been made partially hydrophobic and which may be modified with $Al_2O_3$. The specific surface area is greater than or equal to 150 (±30) $m^2/g$ according to BET. This component has the function of stabilising the fluorescent whitening agent in the liquid detergent composition.

By liquid detergent compositions are meant the known and commercially available detergents disclosed, for example in European patent application 167 205 or U.S. Pat. No. 4 507 219. Preferably these liquid detergent compositions contain 1 to 60% of anionic, nonionic, zwitterionic and optionally cationic surfactants and 10 to 65%, preferably 20 to 55%, of water.

Specifically, the liquid detergent composition of this invention contains, in addition to the fluorescent whitening agent, 3 to 50%, preferably 15 to 25%, of anionic surfactants, 2 to 30%, preferably 4 to 15%, of nonionic surfactants, 3 to 30%, preferably 5 to 20%, of ethoxylated or non-ethoxylated $C_{10}$–$C_{22}$fatty acids, preferably saturated $C_{10}$–$C_{14}$fatty acids such as capric, lauric, myristic, coconut and palm kernel fatty acid and mixtures thereof, 1 to 25%, preferably 1 to 10%, of detergent builders and, as optional components, 1 to 10%, preferably 1 to 5%, of zwitterionic surfactants, 0.5 to 3%, preferably 0.7 to 2%, of quaternary ammonium, amine or amine oxide surfactants, and 1 to 10% of conventional detergent ingredients such as enzymes, enzyme stabilisers, antioxidants, preservatives and bactericides, fragrances and dyes, complexing or sequestering agents, solvents and, as other optional components, one or more polymers and/or copolymers which may be identical with those mentioned above.

Useful surfactants are described, for example, in U.S. Pat. Nos. 4,285,841, 3,929,678 and 4,284,532 and in GB patent specification 2 041 986. It is particularly preferred to use the surfactants cited as preferred in European patent application 167 205. First foremost, however, the anionic sufactants used are non-ethoxylated or ethoxylated $C_{10}$–$C_{18}$alkyl sulfates, for example in the form of the triethanolamine salts, $C_{10}$–$C_{15}$alkylbenzene sulfonates or mixtures thereof, and the nonionic surfactants used are condensates of 1 mol of a $C_{10}$–$C_{15}$fatty alcohol with 3 to 8 mol of ethylene oxide.

Suitable detergent builders are the preferably polycarboxylated compounds cited in U.S. Pat. No. 4,321,165 and 4,284,532, for example citric acid or citrates.

The liquid detergent compositions of this invention are prepared by adding a conventional liquid detergent formulation b), which may contain additional polymer and/or copolymer, and the highly disperse silicic acid c) to an aqueous dispersion a) which contains the above mentioned water-insoluble or sparingly soluble fluorescent whitening agent and one or more of the above polymers and/or copolymers, and homogenising the formulation.

Components a), b) and c) may be incorporated in different phases of the preparation of the liquid detergent composition, while the order in which the additions are made may or should be adapted to the specific detergent formulations and to the apparatus employed.

Preferably a portion of the conventional liquid detergent b) and component c) are added to the whitener dispersion a) and the formulation is homogenised with the remainder of b).

However, component c) may first be added to the liquid detergent b), which is then homogenised with the aqueous whitener dispersion a).

The liquid detergent compositions so obtained are storage-stable over several months and can be used for cleaning fabric without the formation of visually detectable bleach spots.

The present invention further relates to the aqueous dispersion a) which contains 1 to 25%, preferably 5 to 15%, of the cited water-insoluble or sparingly soluble fluorescent whitening agents and 1 to 25%, preferably 5 to 15%, of the cited polymers and/or copolymers, as well as 0.1 to 15%, preferably 0.1 to 10%, of other ingredients such as nonionic surfactants, anionic surfactants, preservatives and anti-freeze agents.

The aqueous dispersion is prepared by mixing the fluorescent whitening agent or agents with the polymer or polymers and/or copolymers and the appropriate amount of water and optional ingredients, and grinding the formulation in a suitable grinding apparatus, for example with quartz sand, until the particle size is smaller than 5 μm, preferably <1 μm.

The low viscosity dispersion so obtained is storage-stable over several months and can be used as described above for the preparation of the liquid detergent compositions of this invention.

The invention is illustrated by the following examples, in which parts and percentages are by weight.

EXAMPLE 1

The following components are mixed in a sand mill:
10 parts of the compound of formula

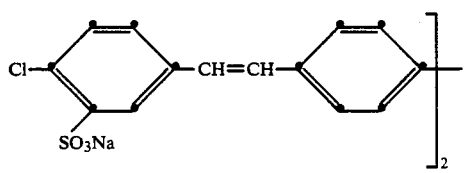

(1)

10 parts of polyvinyl pyrrolidone having an average molecular weight of 40,000 (PVP),
0.5 part of formaldehyde (37% aqueous solution),
79.5 parts of deionised water.

The mixture is ground with quartz sand until the particle size is smaller than 1 μm (median value).

The grinding elements are then separated, to give a low viscosity dispersion which is storage-stable over several months.

EXAMPLE 2

0.67 part of a dispersion according to Example 1 is added to 12.83 parts of deionised water. After mixing,
30 parts of a mixture comprising
10.6 parts of dodecylbenzenesulfonic acid
9.0 parts of deionised water
4.3 parts of 30% aqueous sodium hydroxide, and
6.1 parts of ethanol
are slowly added, with stirring. Then, with intensive stirring, addition is made of 1.0 part of a highly disperse silicic acid having an average surface area of 200±30 $m^2/g$.

Finally, to this mixture are added in succession,
7.9 parts of triethanolamine lauryl sulfate (48%),
1.5 parts of 1,2-propylene glycol,
2.5 parts of triethanolamine, and
43.6 parts of a mixture comprising
3.9 parts of oleic acid
5.35 parts of myristic acid
5.35 parts of lauric acid
11.5 parts of a $C_{14}$–$C_{15}$fatty alcohol with 7 mol of ethylene oxide
7.0 parts of 30% NaOH 5.5 parts of isopropanol
5.0 parts of deionised water.
This entire formulation is homogenised by stirring.

The resultant slightly viscous liquid detergent composition is storage-stable over several months.

EXAMPLE 3

Three detergent formulations are prepared:

A=in accordance with Example 2

B=as A, but without silicic acid (replaced by corresponding amounts of water), the stock whitener dispersion being added direct to the entire remainder of the formulation with intensive stirring C=as A, but without PVP and without silicic acid (replaced by corresponding amounts of water), the stock whitener dispersion being added direct to the entire remainder of the formulation with intensive stirring.

Stability

In the course of a few hours, detergent formulations B and C form a sediment which, even after storage for 1 day at room temperature, can only be redispersed by very intensive and vigorous stirring. Detergent formulation A, on the other hand, is stable after 5 weeks.

Washing Test

Directly after their preparation and after homogenisation by brief stirring, the three detergent formulations A, B and C are subjected to a washing test:

Bleached cotton fabric is washed at a liquour to goods ratio of 1:20 for 15 minutes in a warm aqueous liquor of 30° C. which contains 3 g/l of one of detergent formulations A, B or C. The cotton fabric is then rinsed for 20 seconds in running water and dried at 70° C. in a vacuum drier. The degree of whiteness is determined spectrophotometrically (Zeiss RFC 3) by the method of Ganz.

| Results after 5 washes: at a wash temperature of 30° C. | Degree of whiteness |
|---|---|
| formulation A | 182 |
| formulation B | 184 |
| formulation C | 176 |

The result shows that not only a stable dispersion, but also an enhancement of the efficiency, of the fluorescent whitening agent is achieved with formulation A.

EXAMPLE 4

Spotting Test a) Whitener detergent formulation:

0.6 g of each of detergent formulations A, B and C according to Example 3 is diluted with 400 ml of water (10°-12° German hardness) at a temperature of 30° C. (wash liquors Wa, Wb and Wc).

b) A piece of bleached cotton fabric (20 g) is clamped on a stenter frame.

c) 0.6 ml of each of detergents A, B and C is applied uniformly with a pipette to a premarked round area (5 cm diameter) of this cotton fabric which, after a treatment time of 30 seconds, is put into the prepared wash liquor Wa, Wb and Wc respectively, and washed for 15 minutes at 30° C. The cotton fabric is then rinsed with cold water and dried at 70° C.

d) The difference in the degree of whiteness according to Ganz between the treated area and the surrounding area is a criterion of the so-called spotting behaviour (formation of bleach spots) and is determined by inspecting the textile fabric.

The following differences result in the degree of whiteness of the premarked area and the area surrounding it:

for detergent A=34
for detergent B=10
for detergent C=36 i.e. the addition of polymer effects a reduction of the spotting effect.

EXAMPLE 5

A dispersion similar to that of Example 1 is prepared, except that the 10 parts of polyvinyl pyrrolidone polymer (mol. wt. 40,000) are replaced by 10 parts of polyvinyl pyrrolidone polymer (mol. wt. 700,000), 10 parts of a 3:2 copolymer of vinyl pyrrolidone/vinyl acetate monomers having an average molecular weight of 60,000±15,000 or 10 parts of polyvinyl pyrrolidone having an average molecular weight of 350,000. A comparably good low viscosity, storage-stable dispersion is obtained.

EXAMPLE 6

0.67 part of a dispersion according to either Example 1 or Example 5 is diluted with 11.83 parts of deionised water and then mixed with 87.5 parts of one of the finished formulated detergents D, E or F of the following composition:

D=
- 15% of $C_{11}$-$C_{13}$alkylbenzenesulfonate
- 14% of polyethoxylated $C_{14}$-$C_{15}$fatty alcohol (ethylene oxide 7)
- 10% of soap flakes
- 9% of ethanol
- 4% of sodium citrate
- 5% of triethanolamine
- 1% of highly disperse silicic acid (average surface area 200±30 $m^2/g$)
- 42.0% of water;

E=
- 7.5% of $C_{11}$-$C_{13}$alkylbenzenesulfonate
- 12% of $C_{14}$-$C_{15}$alkylpolyethoxysulfonate (ethylene oxide 2.25)
- 15% of $C_{11}$-$C_{13}$fatty acid, potassium salt
- 10% of polyethoxylated $C_{12}$-$C_{13}$fatty alcohol (ethylene oxide 8)
- 5.5% of sodium citrate
- 12% of a 1:1 mixture of isopropyl alcohol and spirit
- 0.7% of $C_{12}$alkyltrimethylammonium chloride
- 1.0% of highly disperse silicic acid (average surface area 200±30 $m^2/g$)
- 36.3% of water;

F=
- 11.5% of $C_{11}$-$C_{13}$alkylbenzenesulfonate
- 3.8% of triethanolamine lauryl sulfate
- 15.5% of potassium soap
- 15% of polyethoxylated $C_{14}$-$C_{15}$fatty alcohol (ethylene oxide 7)
- 5% of triethanolamine
- 10% of ethanol
- 1.0% of highly disperse silicic acid (average surface area 200±30 $m^2/g$)
- 38.2% of water.

The formulation is then homogenised.

The liquid detergent compositions so obtained are storage stable over several months or exhibit only a slight sedimentation which can be very readily rehomogenised by mild shaking, and they have a good whitening effect and induce no or only insignificant spotting.

EXAMPLE 7

The following dispersions (G, H and K) containing the fluorescent whitening agent of formula

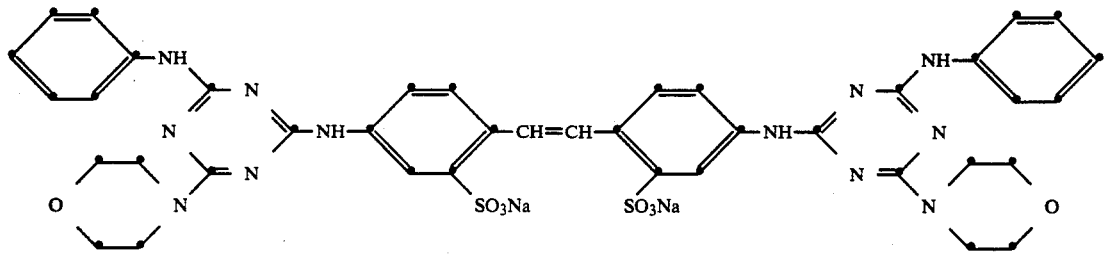

(2)

are prepared:

G:
- 1 part of the fluorescent whitening agent of formula (2), and
- 99 parts of deionised water;

H:
- 1 part of the fluorescent whitening agent of formula (2),
- 1 part of the 3:2 copolymer of vinyl pyrrolidone/vinyl acetate monomers (mol. wt. 60,000±15,000), and
- 98 parts of deionised water;

K:
- 1 part of the fluorescent whitening agent of formula (2),
- 1 part of the 3:2 copolymer of vinyl pyrrolidone/vinyl acetate monomers (mol. wt. 60,000±15,000),
- 5 parts of highly disperse silicic acid having an average surface area of 200±30 $m^2/g$, and
- 93 parts of deionised water.

K is obtained as a good low viscosity, storage-stable dispersion, whereas G and H exhibit rapid sedimentation.

What is claimed is:

1. A non-spotting, liquid detergent composition, stable for several months, consisting of
   - 0.001% to 0.2% of at least one water-insoluble or sparingly-soluble fluorescent whitening agent,
   - 0.001% to 0.2% of at least one polyvinyl pyrrolidone polymer or copolymer having an average molecular weight of 8,000 to 1,000,000, and, as copolymer, at least one 1:4 to 4:1 copolymer of vinyl pyrrolidone/vinyl acetate monomers, having an average molecular weight of 20,000 to 100,000, or at least one 1:1 copolymer of vinyl pyrrolidone/3-vinylpropionic acid monomer,
   - 0.2% to 5% of at least one highly disperse silicic acid,
   - 1% to 60% of surfactant,
   - 1% to 10% of detergent builder,
   - 1% to 10% of conventional detergent ingredients selected from the group consisting of enzymes, enzyme stabilizers, preservatives, fragrances, dyes, complexing agents, solvents, polymers and copolymers other than polyvinyl pyrrolidone polymers and copolymers, and
   - 10% to 65% of water.

2. A liquid detergent composition according to claim 1 wherein citric acid or a citrate are used as detergent builder.

3. A liquid detergent composition according to claim 1 which contains one or more fluorescent whitening agents of formulae

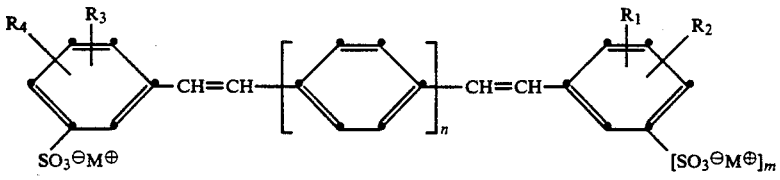

(I)

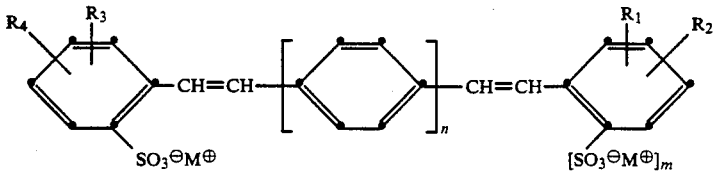

(II)

-continued (III)

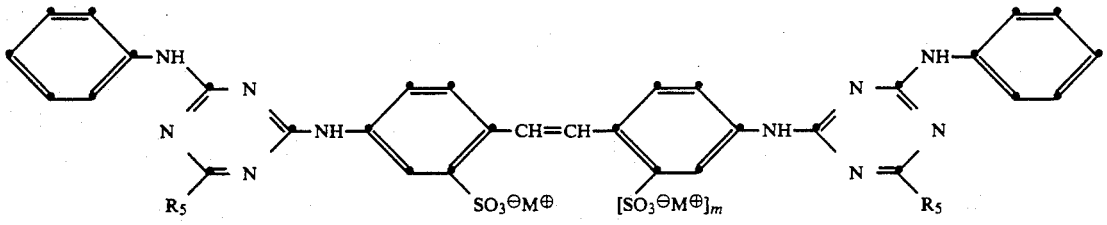

(IV)

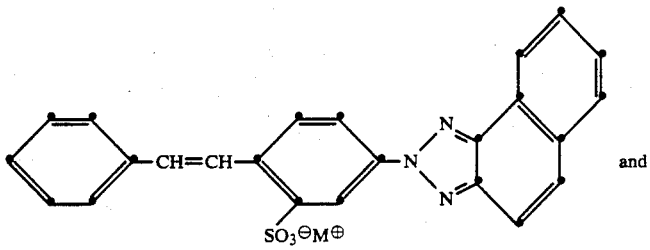

and (V)

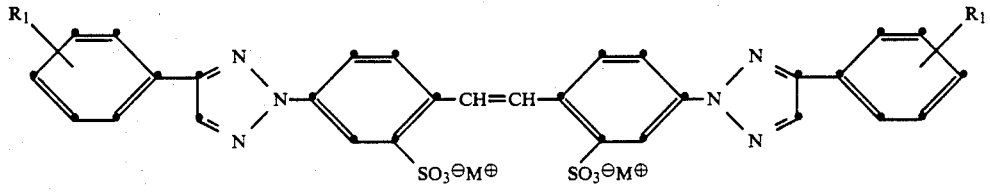

wherein $R_1$, $R_2$, $R_3$ and $R_4$ are each independently of one another H, Hal or $C_1$–$C_4$alkyl, or, when taken together, are each a cyclohexane radical, $R_5$ is NH-($C_1$–$C_4$alkyl) or a 4-morpholino radial, n is 1 or 2, m is 0 or 1, and M⊕ is a salt-forming cation.

4. A liquid detergent composition according to claim 1, which contains at least one polyvinyl pyrrolidone having an average molecular weight of 35,000 to 800,000 or at least one 4:1 to 1:1 copolymer of vinyl pyrrolidone/vinyl acetate monomers having an average molecular weight of 45,000 to 75,000.

5. A liquid detergent composition according to claim 1, which contains at least one polyvinyl pyrrolidone having an average molecular weight of 35,000 to 800,000, or at least one 3:2 copolymer of vinyl pyrrolidone/vinyl acetate monomers having an average molecular weight of 45,000 to 75,000, a fluorescent whitening agent of formula (VI)

wherein $R_7$ and $R_6$ are H, Cl, F, or $CH_3$,

M⊕ is H, Na, K, Li, $NH_4$, $HN(CH_2—CH_2OH)_3$,

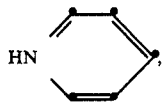

$H_2N(CH_2—CH_2OH)_2$, $H_3N—CH_2—CH_2OH$, $H_2N(CH_3)_2$, or $H_3N—CH_3$, and n is 1 or 2, and highly disperse silicic acid.

6. A liquid detergent composition according to claim 5, which contains at least one polyvinyl pyrrolidone having an average molecular weight of 35,000 to 800,000, or at least one 3:2 copolymer of vinyl pyrrolidone/vinyl acetate monomers having an average molecular weight of 45,000 to 75,000, a fluorescent whitening agent of formula (VI)

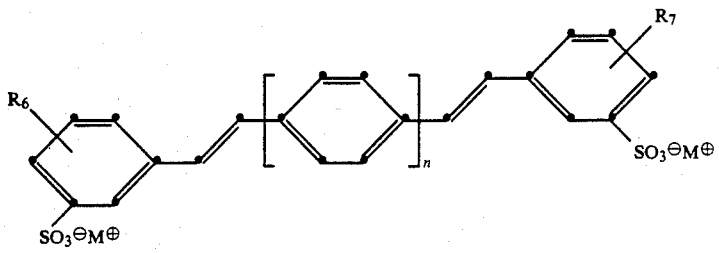

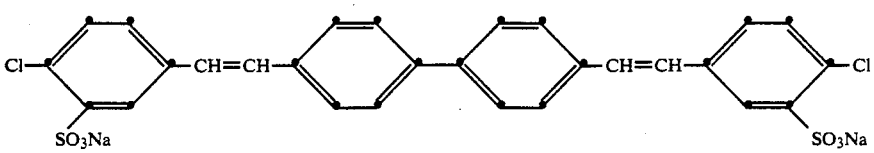

(1)

and highly disperse silicic acid.

7. A liquid detergent according to claim 1, which contains 10 to 65% of water, 3 to 50% of anionic surfactants, 2 to 30% of nonionic surfactants, 3 to 30% of $C_{10}$–$C_{22}$fatty acids, 1 to 10% of detergent builders, and other optional detergent ingredients.

8. A liquid detergent composition according to claim 7, wherein the other optional detergent ingredients are further polymers and/or copolymers which may be identical with those claimed in claim 4.

9. A process for the preparation of a liquid detergent composition as claimed in claim 1, which comprises adding a liquid detergent formulation to an aqueous dispersion a) which contains 1 to 25% of a fluorescent whitening agent according to claim 2 and 1 to 25% of polymer and/or copolymer according to claim 4, and homogenising the formulation, while adding 0.2 to 5% of highly disperse silic acid during the preparatory process.

* * * * *